United States Patent [19]

Smith et al.

[11] 4,291,994

[45] Sep. 29, 1981

[54] TEAR RESISTANT RIBBON FOR NON-IMPACT PRINTING

[75] Inventors: Thor L. Smith, Los Altos Hill; William J. Weiche, Los Gatos, both of Calif.

[73] Assignee: International Business Machines Corporation, Armonk, N.Y.

[21] Appl. No.: 134,375

[22] Filed: Mar. 27, 1980

[51] Int. Cl.[3] ..... B41J 31/02

[52] U.S. Cl. ..... 400/241.1; 400/118; 428/412

[58] Field of Search ..... 400/118, 119, 120, 237, 400/240, 240.1, 240.2, 240 A, 241, 241.1, 241.2, 241.4; 428/412; 101/460

[56] References Cited

U.S. PATENT DOCUMENTS

| | | | |
|---|---|---|---|
| 2,713,822 | 7/1955 | Newman | 101/460 X |
| 3,117,018 | 1/1964 | Strauss | 428/412 |
| 3,413,183 | 11/1968 | Findlay et al. | 428/412 X |
| 3,744,611 | 7/1973 | Montanari et al. | 400/120 |
| 3,844,826 | 10/1974 | Buchner et al. | 428/412 X |
| 4,103,066 | 7/1978 | Brooks et al. | 400/118 X |

OTHER PUBLICATIONS

IBM Technical Disclosure Bulletin, "Resistive Ribbon Ink Layers", Crooks et al., vol. 22, No. 2 Jul. 1979, p. 782.

*Primary Examiner*—Ernest T. Wright, Jr.
*Attorney, Agent, or Firm*—Joseph G. Walsh

[57] ABSTRACT

The present invention is concerned with a ribbon for non-impact printing. The ribbon comprises a transfer coating and a substrate containing resin which is a mixture of from 50% to 90% by weight polycarbonate and from 50% to 10% by weight of a block copolymer of bis-phenol A Carbonate and dimethyl siloxane, and containing from about 15% to about 40% by weight of the resin of electrically conductive carbon black.

6 Claims, No Drawings

TEAR RESISTANT RIBBON FOR NON-IMPACT PRINTING

DESCRIPTION

1. Technical Field

The present invention is concerned with a ribbon for use in non-impact printing. In particular, it is concerned with a resistive ribbon for use in a process in which printing is achieved by transfering ink from a ribbon to paper by means of local heating of the ribbon. Localized heating may be obtained, for example, by contracting the ribbon with point electrodes and a broad area contact electrode. The high current densities in the neighborhood of the point electrodes during an applied voltage pulse produce intense local heating which causes transfer of ink from the ribbon to a paper in contact with the ribbon.

2. Prior Art

Non-impact printing is known in the art. See for example, U.S. Pat. Nos. 2,713,822 and 3,744,611. This latter patent described a non-impact printing process employing a ribbon containing a transfer coating and a substrate. The patent mentions the use of conductive carbon black in the substrate, but is entirely devoid of any teaching in regard to the use of polycarbonate resin.

U.S. Pat. No. 4,103,066 describes a resistive ribbon in which the substrate is polycarbonate resin containing electrically conductive carbon black. Excellent results have been obtained using this substrate. The substrate, however, has the disadvantage of being difficult to handle in actual machine use. In particular, it has poor resistance to tearing. Its elongation-to-break is only from about ½ to about 2%. This tendency to tearing creates serious handling problems in usage.

SUMMARY OF THE INVENTION

The present invention provides a ribbon for use in non-impact printing, in particular, for use in thermal transfer printing. The invention comprises a transfer coating and a substrate which comprises a mixture of from about 90 to 50% by weight polycarbonate with from about 10 to about 50% by weight of a block copolymer of bisphenol A carbonate and dimethyl siloxane with from about 15 to about 40% by weight of electrically conductive carbon black.

For use in thermal non-impact printing the substrate resin must enable the electrically conducting carbon black to be dispersed uniformly. This dispersion must simultaneously have the required degree of electrical resistance. In addition, the ribbon must be capable of being made easily. The ribbon of the present invention has all of these properties and, in addition, the advantage of being resistant to tearing.

The substrate of the present invention may be used with any transfer coating known in the prior art for non-impact printing. A typical transfer coating comprises a resin and color material, particularly, carbon and/or a dye. In general, the transfer coating is from about 1 to about 5 microns thick.

The substrate of the present invention contains from about 15% to about 40% by weight of the resin of conductive carbon black. About 30% by weight is preferred. When the concentration of the carbon is above about 40% the film tends to lose integrity. When the concentration of the carbon black is below about 15%, the electric conductivity tends to be too low.

Polycarbonate resin is a staple article of commerce and is available commercially from several manufacturing sources. For example, it is available from General Electric Company under the trademark "Lexan" and from Mobay Corp. under the trademark "Merlon".

Carbon black is available from numerous commercial sources. For the present invention, furnace blacks are preferred since they are more electrically conductive than channel blacks. The typical commercially available conductive carbon black has a very small particle size on the order of about 250A.

Block copolymer of bis-phenol A carbonate and dimethyl siloxane is a commercially available material. It may, for example, be obtained from General Electric Company under the designation GE #3320. The substrate layer of the ribbons of the present invention is preferably from about 5 to 35 microns in thickness. The best results are obtained from about 10 to about 20 microns.

The following examples are given solely for purposes of illustration and are not to be considered limitations on the invention, many vatiations of which are possible without departing from the spirit or scope thereof.

BEST MODE FOR CARRYING OUT THE INVENTION

Example 1

A ribbon was formulated by blending a polycarbonate resin (Mobay Corporation M-50) with a block copolymer of bis-phenol A carbonate and dimethyl siloxane. The block copolymer was General Electric No. 3320. A resistive formulation is 4.13 grams of M-50, 4.13 grams GE #3320, 3.5 grams of carbon black (Cabot Corp carbon XC-72). These materials were dispersed in 156 grams of methylene chloride and coated onto polyethylene terephthalate to a dry thickness of 16 microns. The film was then aluminized on one side to give a high conductive layer and then coated on the aluminized side with a 3-micron layer of thermoplastic ink.

The final ribbon was then stripped from the polyethylene terephthalate and tested on the print robot. Good print was obtained at 0.90 watts/electrode at 10 inches/second. By comparison, the polycarbonate substrate ribbon prints at 0.75 watts/electrode at 10 inches/second.

As shown below, a 50/50 blend of M-50 and the GE block copolymer gives a resistive layer of the ribbon that has an elongation-at-break of 28%, whereas it is about 2% when the block copolymer is not addes to the formulation. Also, its stiffness (modulus) and tensile strength, although less than those of the all purpose formulation, are clearly adequate and significantly higher than those obtained using the block copolymer alone.

| Resistive Layer | Tensile Strength | Elongation-at-break | Modulus |
|---|---|---|---|
| Polycarbonate alone | 8974 psi | 2.0% | $5.6 \times 10^5$ psi |
| Block copolymer alone | 2452 psi | 50.0% | $0.49 \times 10^5$ psi |
| 50/50 polycarbonate and block copolymer | 3622 psi | 28.0% | $1.3 \times 10^5$ psi |
| 75% polycarbonate and 25% block copolymer | 5800 psi | 16.0% | $3.2 \times 10^5$ psi |

The preferred 75/25 layer was aluminized and coated with a 3-micron thick transfer layer. Excellent print was obtained at 0.75 watts/electrode at 10 inches per second.

We claim:

1. A ribbon for non-impact printing comprising a transfer layer and a substrate which is a mixture of resin comprising from about 90% to about 50% by weight of polycarbonate and from about 10% to about 50% by weight of a block copolymer of bis-phenol A and dimethyl siloxane and based upon the total weight of the resin mixture from about 15% to about 40% by weight of electrically conductive carbon black.

2. A ribbon as claimed in claim 1 wherein the mixture of resin comprises about 75% by weight polycarbonate and about 25% by weight block copolymer of bis-phenol A carbonate and dimethyl siloxane.

3. A ribbon as claimed in claim 1 wherein carbon black is present at about 30% by weight of the resin mixture.

4. A ribbon as claimed in claim 1 wherein the substrate is from about 10 to 20 microns thick.

5. A ribbon as claimed in claim 1 wherein the transfer coating comprises wax or a resin and coloring matter.

6. A ribbon for non-impact thermal transfer printing comprising a transfer layer and a substrate of about 15 microns thickness which comprises a mixture of 75% by weight polycarbonate resin and 25% by weight block copolymer of bis-phenol A and dimethyl siloxane with about 30% by weight of the resin of electrically conductive carbon black.

* * * * *